US008251095B2

(12) United States Patent
Trumper

(10) Patent No.: US 8,251,095 B2
(45) Date of Patent: Aug. 28, 2012

(54) ARTICULATED MAST FOR A THICK-MATTER DELIVERY INSTALLATION

(75) Inventor: Siegfried Trumper, Dortmund (DE)

(73) Assignee: Schwing GmbH (DE)

( * ) Notice: Subject to any disclaimer, the term of this patent is extended or adjusted under 35 U.S.C. 154(b) by 1011 days.

(21) Appl. No.: 12/094,594

(22) PCT Filed: Nov. 17, 2006

(86) PCT No.: PCT/EP2006/011079

§ 371 (c)(1),
(2), (4) Date: Sep. 11, 2008

(87) PCT Pub. No.: WO2007/059904

PCT Pub. Date: May 31, 2007

(65) Prior Publication Data

US 2009/0028633 A1 Jan. 29, 2009

(30) Foreign Application Priority Data

Nov. 22, 2005 (DE) ..... 10 2005 055 667

(51) Int. Cl.
*E03B 1/00* (2006.01)
*B05B 1/20* (2006.01)

(52) U.S. Cl. ..... 137/615; 239/165

(58) Field of Classification Search ..... 137/615, 137/274, 276, 279, 801; 239/165, 159; 403/52–54, 403/66, 75, 78, 100–102; 248/278.1, 281.11, 248/285.1, 494, 495

See application file for complete search history.

(56) References Cited

U.S. PATENT DOCUMENTS

| | | | | | |
|---|---|---|---|---|---|
| 531,121 | A * | 12/1894 | Hofbeck | ..... | 403/100 |
| 2,296,250 | A * | 9/1942 | Bennett | ..... | 416/105 |
| 3,009,646 | A * | 11/1961 | Purtell | ..... | 239/736 |
| 3,374,009 | A * | 3/1968 | Jeunet | ..... | 280/287 |
| 6,484,752 | B1 * | 11/2002 | Ebinger et al. | ..... | 137/615 |
| 6,871,667 | B2 * | 3/2005 | Schwing et al. | ..... | 137/615 |
| 6,942,235 | B2 * | 9/2005 | Chang | ..... | 280/278 |

FOREIGN PATENT DOCUMENTS

| | | |
|---|---|---|
| DE | 196 44 412 A1 | 4/1998 |
| DE | 199 59 070 A1 | 6/2001 |
| JP | 02225146 A | 9/1990 |

OTHER PUBLICATIONS

International Search Report prepared by the European Patenet Office on Feb. 12, 2007, for International Application No. PCT/EP2006/011079; Applicant, Schwing GmbH.

* cited by examiner

*Primary Examiner* — John Rivell
*Assistant Examiner* — Hailey K Do
(74) *Attorney, Agent, or Firm* — Sheridan Ross P.C.

(57) ABSTRACT

Articulated mast, in particular for concrete delivery installations, comprising at least two mast sections connected to one another by means of a swivel joint and having a straight longitudinal extent, wherein one mast section can be swiveled about a swivel joint axis with respect to the adjacent mast section, such that the articulated mast can be shifted from a folded transport position into a swung-out working position and wherein at least one swivel joint of the articulated mast has an inclined swivel joint axis.

Figure 1:
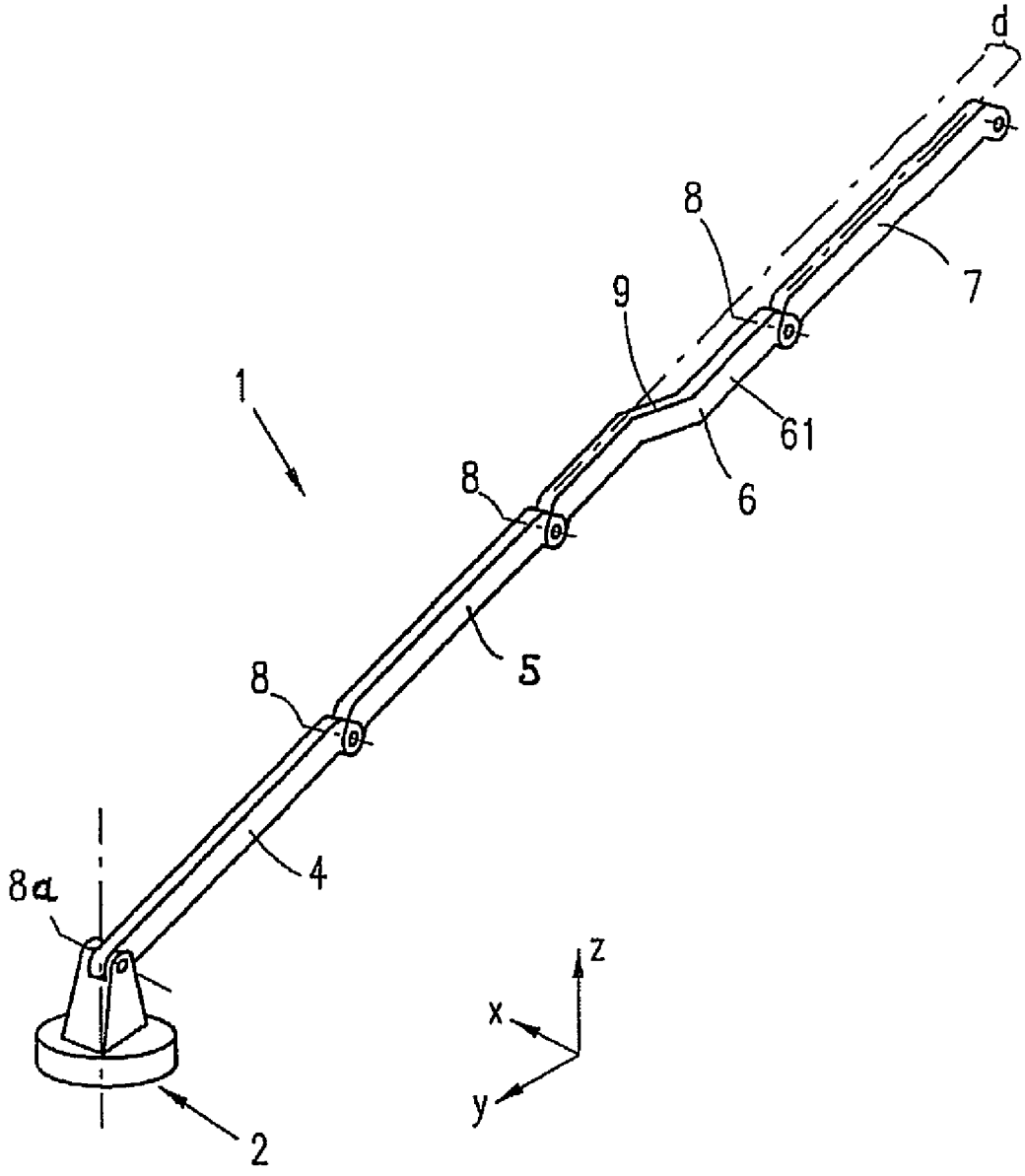

8 Claims, 5 Drawing Sheets perpendicular to longit. axis

ARTICULATED MAST FOR A THICK-MATTER DELIVERY INSTALLATION

CROSS REFERENCE TO RELATED APPLICATIONS

This application is a national stage application under 35 U.S.C. 371 of PCT Application No. PCT/EP2006/011079 having an international filing date of 17 Nov. 2006, which designated the United States, which PCT application claimed the benefit of German Application No. 10 2005 055 667.1 filed 22 Nov. 2005, the entire disclosure of each of which are hereby incorporated herein by reference.

The present invention concerns an articulated mast comprising several mast sections connected such that they can swivel together as defined in the generic term of claim 1.

During the delivery of thick matter, for example concrete, mortar and the like, height differences are overcome by means of so-called delivery installations with which the thick matter to be delivered is delivered to the desired placement point through a delivery line or a piping system. The delivery pressure and/or delivery flow rate is generated here by a thick-matter pump. Such delivery installations are commonly designed as a combination of pipe system with an articulated and/or telescopic mast, which is mounted on a truck, for example. Of course, such a delivery installation may also be stationary in design or implemented as manipulators. In the event that such a delivery installation is mounted on a truck, the latter is initially aligned horizontally at the point of use and secured against tilting. Only then can the individual mast sections or mast arms of the articulated mast be unfolded or swung out and the delivery installation be started up. The thick-matter pump then conveys the externally provided thick matter through a pipe system, which is arranged along the articulated mast sections, to the desired placement point, where the thick matter, for example, exits the pipe system via a trunk-like hose extension. The height differences to be surmounted are considerable and can amount to 50 m and more. Of course, such delivery installations can also be used to overcome horizontal distances, e.g. in difficult or inaccessible terrain.

The individual mast sections of the articulated mast are typically connected to each other by means of swivel bearings or swivel joints. The positioning forces are applied in the known manner, for example, by hydraulic cylinders, with the hydraulic cylinder being arranged between two adjacent mast sections connected to each other by means of the swivel joint. The deployment and retraction of the piston rod causes the one mast section to swivel relative to the other mast section, which is usually fixed in position at this juncture.

The entire articulated mast or mast superstructure is mounted to a so-called mast pedestal and rotatably mounted about a vertical axis at this. The mast section arranged at the mast pedestal is typically termed the first mast section, with subsequent mast arm sections being numbered consecutively. Most frequently, articulated masts have two, three or four individual mast sections and are therefore termed two-, three- or four-member articulated masts.

When the mast sections are being folded from an operating position into a transport or resting position, space considerations generally create the problem that as one of the mast sections, especially the third of a four-member articulated mast, is being folded together, it has to be moved past the side of a preceding or previous mast section, because the latter cannot be placed directly beneath the preceding mast section if an unfavorable stacking height is to be avoided. This can also be the case for the second mast section in the event that, as it is being folded, it has to be moved past the first mast section or other superstructures. For this reason, the mast sections concerned have an offset configuration, which enables the mast section to be moved past.

The offset causes the centre-of-gravity line of the mast section concerned to shift in the unfolded state. The offset, however, also causes a lateral shift in weight of the mast sections following the offset mast section, including the swivel joints and the delivery line sections mounted to the mast sections. In the unfolded state, high transverse forces therefore act, which also induce torsional moments in the individual mast sections (the stresses resulting from the torsional moments are extremely high, especially in the offset region) and lead to high flexural or tilting moments, especially in the swivel joints and in the area where the articulated mast is mounted to the mast pedestal. For this reason, the individual mast sections and swivel joints, as well as the mounting to the articulated mast at the mast pedestal, have to be of a correspondingly stable design, a fact which additionally incurs structural outlay. Additionally, the high structural outlay has a disadvantageous effect on the corresponding weight of the articulated mast.

The object of the invention is to reduce the resultant transverse forces and flexural moments at an articulated mast so as to be able to keep the structural outlay low. The object solution is also intended to yield economic advantages over the known prior art.

This object is achieved with the features of the characterizing part of claim 1. The features of the referenced subclaims indicate logical further developments and embodiments.

The effect of the inclination of the swivel joint axle with which the mast section for moving past is mounted by its one end to the immediately preceding mast section is for this mast section to be deflected laterally from the preceding articulated mast, i.e. to become splayed at the connecting swivel joint, while the articulated mast is in the resting or transport position. The two longitudinal axes of the mast sections concerned intersect more or less in the swivel joint and form an angle of spread $\alpha$. If the mast sections are swiveled out of their resting or transport position into a working position, they align themselves in a vertical reference plane, which essentially extends plumb with respect to the first mast section.

Comparatively low transverse forces act on the articulated mast only as it is being unfolded or folded, as a result of which the overall torsional and flexural moments acting on the mast sections and the mast superstructure are only small. The structural components concerned can be dimensioned smaller commensurate with the lower load, as a result of which the weight, but also the material and production costs of the articulated mast, are reduced.

As a mast section is unfolded about an inclined swivel joint axle, the mast sections, which are connected by means of a swivel joint, approach the ideal state of a common alignment as the swivel angle increases, in that they are aligned within the vertical reference plane. However, even in non-ideal alignment conditions, a marked improvement over the prior art is obtained as regards the resulting transverse forces.

The inclination of the swivel joint axle can be determined by means of an angle of inclination $\beta$, with this angle, in terms of a perpendicular of the longitudinal axis of a preceding mast section, typically being determined on the first mast pedestal mounted to the mast section. To this end, the angle of inclination for simplicity can be determined in a horizontal plane. The angle of inclination $\beta$ should not be more than 22.5°, preferably not more than 15°, particularly preferably not more than 10° and most especially preferably not more than 8°, as otherwise the resulting angle of spread α and thus the resultant torsional moments (or transverse forces) are too large.

The angle of inclination β of the inclined swivel joint axle can be advantageously determined in a horizontal plane which assumes a perpendicular position to the vertical reference plane. In this case, only the planar portion, i.e. the angle projection of the inclination into the horizontal plane, is determined, at which any inclination portions are not ignored.

If the articulated mast comprises more than two mast sections, it is advantageous to also mount an inclined swivel joint axle to the third mast section following the splayed mast section, i.e. the one laterally deflected, such that the splayed mast section, which is mounted to it by means of the swivel joint (with inclined swivel joint axle), being mounted to be sure essentially in the vertical reference plane when the articulated mast is in the unfolded working position, but, in the folded resting or transport position, the following mast section is essentially arranged parallel to the mast section preceding the splayed mast section.

In the case just illustrated of several inclined swivel joint axles, it is advantageous for the angles of inclination β and β' to have approximately the same angle values. This reduces the production outlay during setting of the joint drill-holes, but also facilitates the preceding kinematic calculations. It also ensures that that mast section which is in the resting or transport position and which follows the splayed mast section is arranged essentially parallel to the mast section preceding the splayed mast section.

For the frequently encountered practical case in which the articulated mast comprises more than two mast sections, for example, four mast sections, it is advantageous for the laterally deflected splayed mast section in the resting position to be the second or third mast section, as counted from the mast mounting to the mast pedestal In the latter case, the first and second mast sections are arranged on top of each other in the resting or transport position, while the two following mast sections are staggered laterally, as a result of which a favorable weight distribution in the resting position is achieved.

In the resting position, the longitudinal axis of the splayed laterally deflected mast section forms an angle of spread α with the longitudinal axis of the preceding mast section, which mast section, for simplicity, is also defined as a planar angle in a horizontal plane. The angle of spread α is roughly twice the angle value of the angle of inclination β of the inclined swivel joint axle, i.e. the following mathematical relations apply: $\alpha \approx 2\beta$ or $\beta \approx \alpha/2$.

In order, as previously described, that a third mast section following the splayed and thus laterally deflected mast section in the resting or transport position of the articulated mast may be arranged parallel to the mast section preceding the splayed mast section, the two angles of spread α and α', i.e. the angles between the longitudinal axes of the splayed and its preceding mast section and between the longitudinal axes of the splayed and its subsequent mast section, must have approximately the same angle value. However, it is also possible for the two angles of spread α and α' to have different angle values.

The ideal state of a common alignment of the individual sections of an articulated mast in which these are aligned within the vertical reference plane, does not require the maximum swivel angle γ between each of two swiveling interconnected mast sections to have an angle of 180°. The articulated mast can already during design be optimized with a view to later expected use in such a manner as to guarantee that the maximum possible swivel angle γ between each of two adjacent mast sections is significantly less than 180°, for example, only 90°, or much more than 180°, for example, 220°. An end position for each corresponding swivel of the individual mast sections can be designed, for example, as stops in the swivel joints or be effected by the use of hydraulic cylinders of corresponding stroke length. This allows weight and costs to be reduced. If one or more joint inclined swivel joint axles is/are provided in the articulated mast, the ideal state of common alignment of the individual mast sections must be matched to this expected application by aligning these within the vertical reference planes. In other words, the mast sections of an articulated mast must, regardless of the individual maximum possible swivel angles, assume an aligned position during unfolding into a working position, in which these are aligned within the vertical reference plane.

Figure 2:
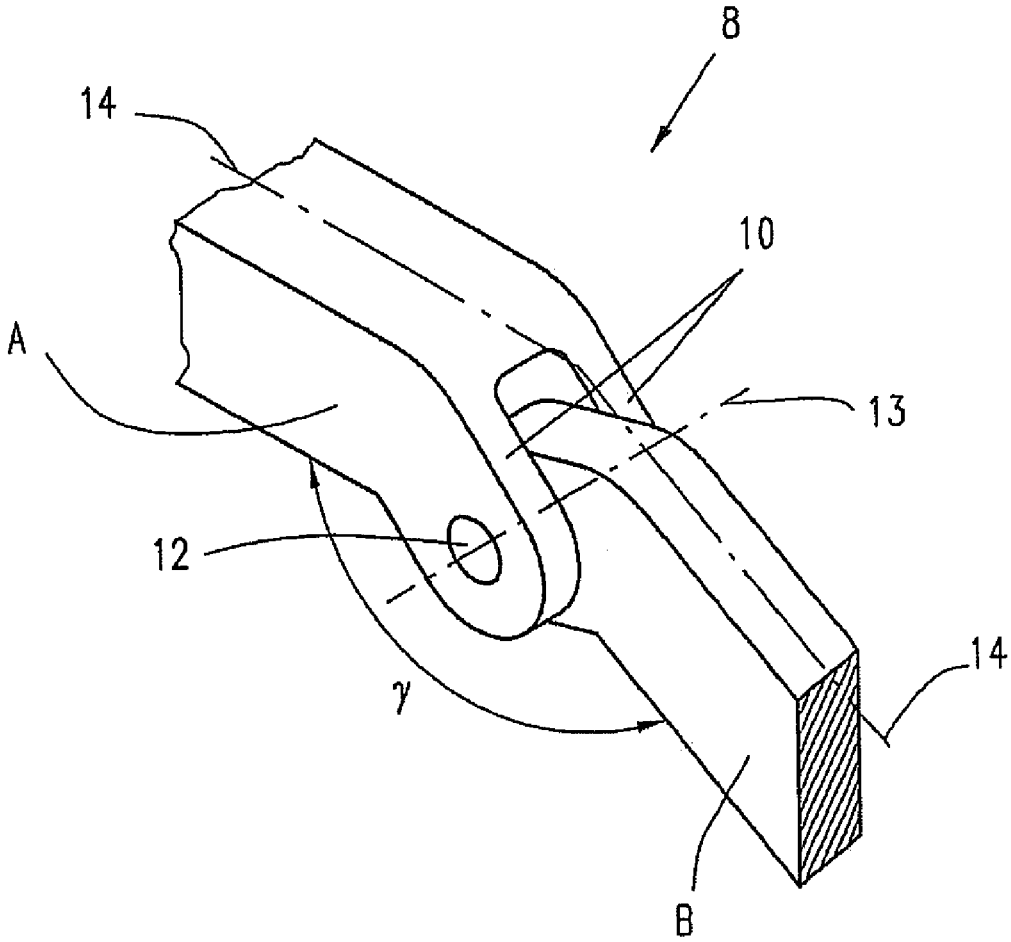
Figure 3:
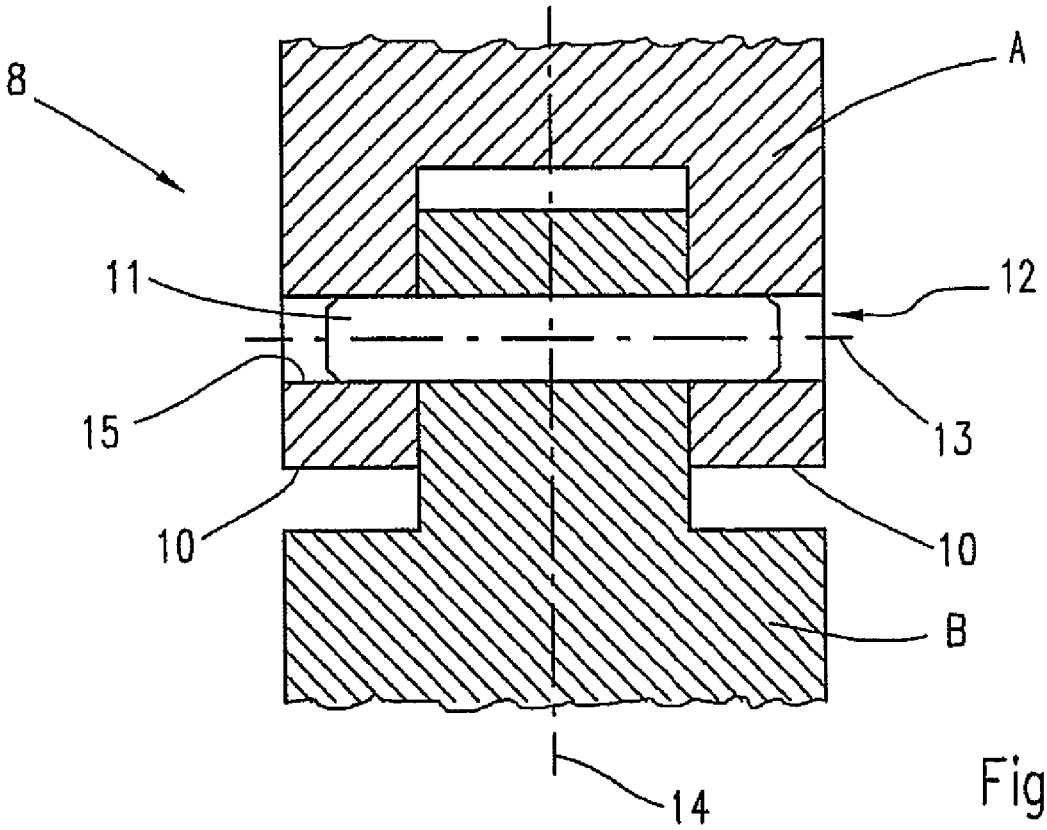
Figure 4:
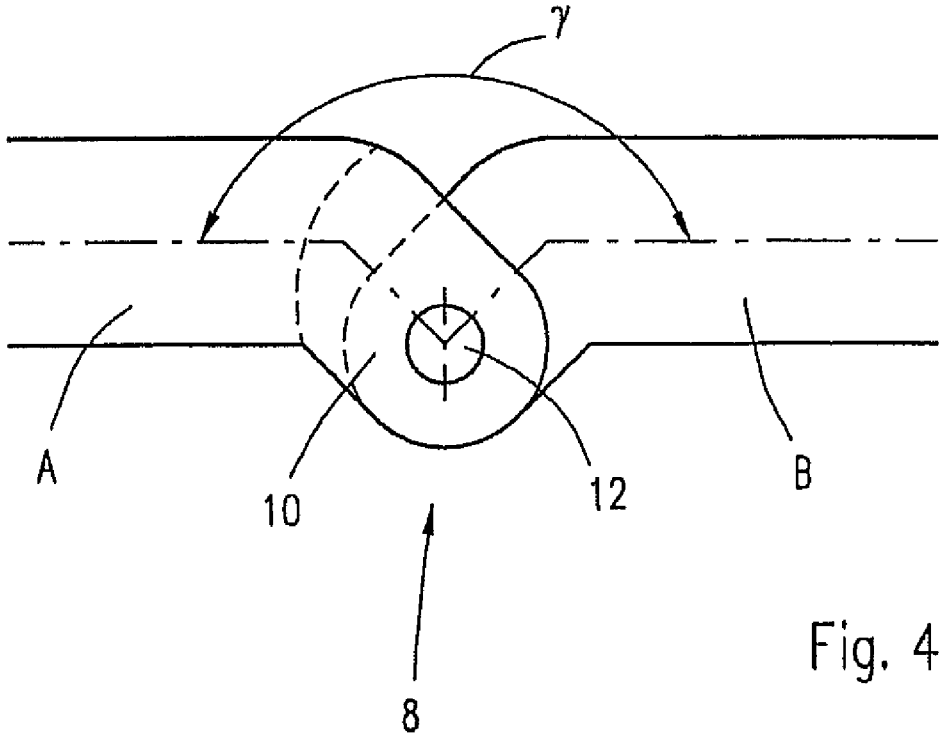
Figure 5:
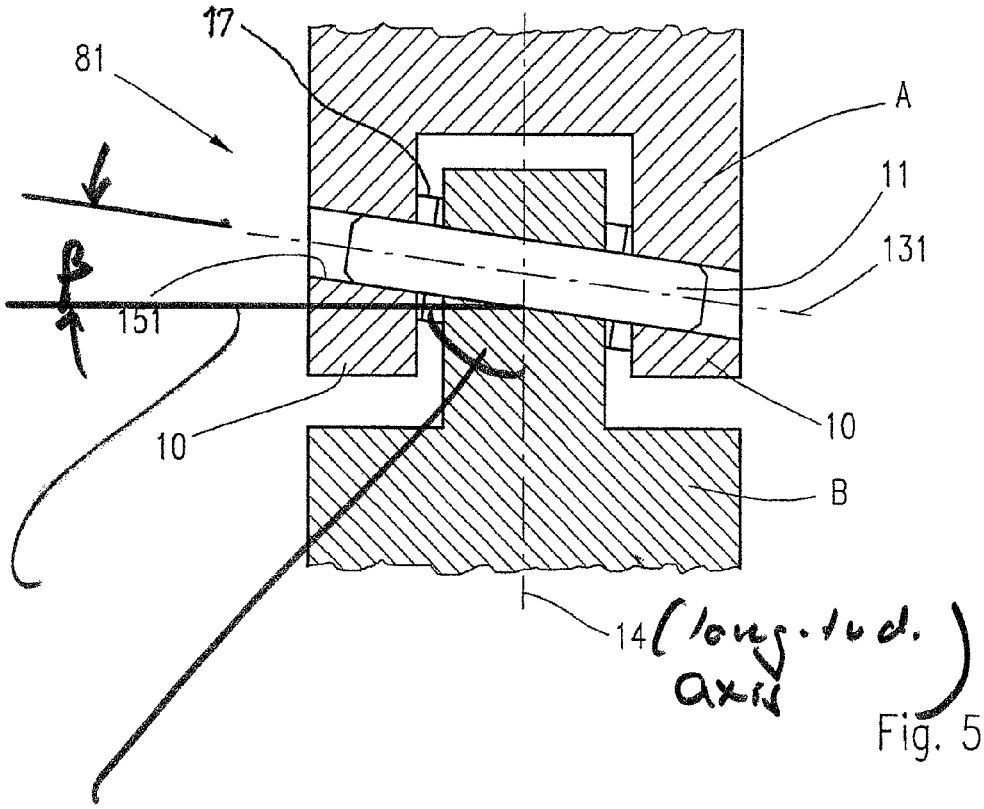
Figure 6:
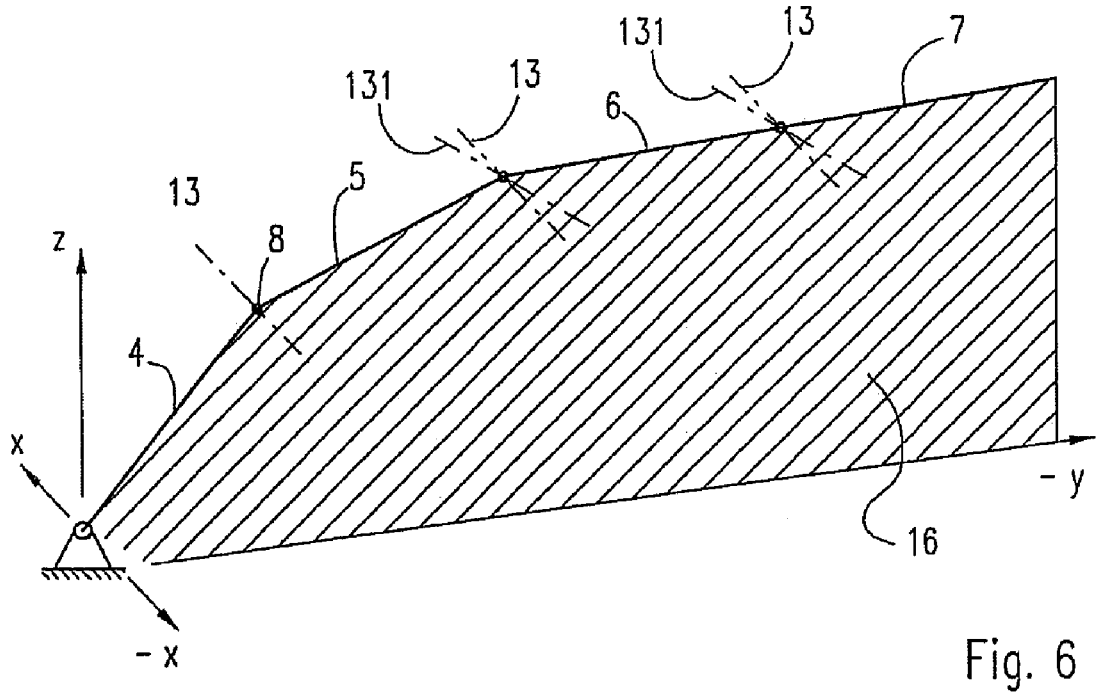
Figure 7A:
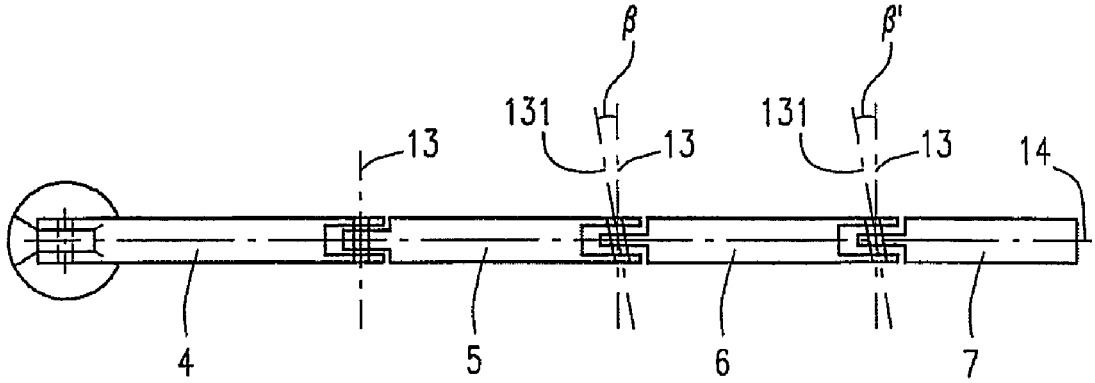
Figure 7B:
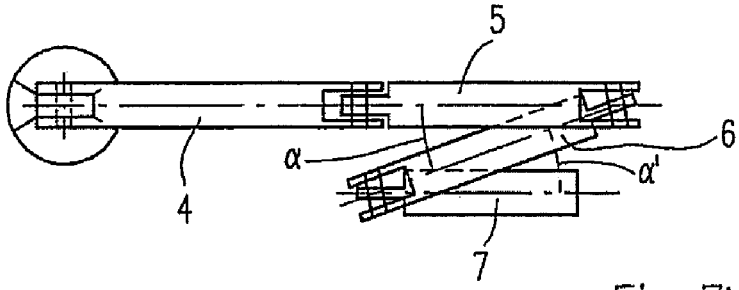

An embodiment of the articulated mast is described and explained in more detail using the following figures. They show in FIG. 1 An articulated mast of the prior art in perspective view;

FIG. 2 A swivel joint of an articulated mast as per FIG. 1 in perspective view;

FIG. 3 A swivel joint as per FIG. 2 in partial cross-section;

FIG. 4 A swivel joint as per FIG. 2 in lateral view;

FIG. 5 A swivel joint with inclined swivel joint axle in partial cross-section;

FIG. 6 A simplified, schematic representation of an articulated mast unfolded as per FIG. 1, in a perspective view;

FIG. 7*a* A schematic representation of the articulated mast as per FIG. 6, viewed from above;

FIG. 7*b* A schematic representation of the articulated mast as per FIG. 6 in the resting or transport condition, viewed from above.

FIG. 1 shows by way of example an articulated mast or mast superstructure, corresponding to the prior art and labeled 1, in working position, said mast or superstructure being attached to a mast pedestal 2 such that it can swivel, with the mast pedestal 2 typically capable of rotation about a vertical axis (z-axis). The mast pedestal 2 can, for example, be mounted on a truck, not shown, of a concrete-delivery vehicle, or also attached to a stationary installation. The articulated mast 1 is composed of a succession of individual mast sections or mast arms 4 to 7. The articulated mast 1 shown is a four-member mast superstructure. A swivel joint 8 combines two adjacent mast sections in each case. The four-member mast superstructure shown therefore comprises three swivel joints 8, plus a fourth swivel joint 8*a* via which the mast superstructure is itself articulated at the mast pedestal 2. For the sake of clarity, FIG. 1 does not show any further structural elements, such as the concrete-delivery line and its means of attachment, or the hydraulic swivel cylinders and their connecting cables and the like.

When the articulated mast 1 is in the folded resting or transport position, space considerations necessitate that, depending on the length of individual mast sections or on account of necessary superstructures on the chassis of the concrete-delivery vehicle, at least one mast section be arranged such that it is laterally staggered from the other mast sections and thus has to be guided laterally past another mast section. This measure also serves to lower the vehicle's center of gravity. In the embodiment of FIG. 1, when the articulated mast 1 is in the resting or transport position, the second mast section 5 may be compactly arranged under the first mast section 4, but no further space would be available for arranging a third mast section 6 or even a fourth mast section 7 beneath the mast sections 4 and 5, with the result that the third mast section 6 at least must be guided past laterally. To this end, the third mast section 6 has an offset designated 9, through which the rear part 61 of the third mast section and the subsequent fourth mast section 7 are laterally staggered by an amount d. As a result of the offset 9, when the articulated mast 1 is folded from the working position into the resting or transport position, the individual mast sections reach their end positions to some extent lying side by side, and as a result of the offset a largely compact folded position is achieved.

The articulated mast 1 is moved into its transport or resting position by folding the fourth mast section 7 under the third mast section 6, the third mast section 6 onto the second mast section 5 and the second mast section 5 under the first mast section 4. In the transport position, therefore, the second mast section 5 and the third mast section 6 are arranged beneath the first mast section 4, with the lowermost third mast section 6 projecting outwardly and laterally from the stack at its offset 9 and, on its staggered rear mast section 61, lies the fourth mast section 7. This is just an exemplary arrangement that may vary in accordance with the implementation of the articulated mast. The objective on one hand is to reduce the stack height, but on the other to also optimize the center of gravity.

FIG. 2 shows the possible embodiment of a swivel joint 8 in a perspective view, by means of which two adjacent mast sections, labeled A and B here by way of example, are interconnected such that they can swivel. The mast section A has a bifurcated end 10, which accommodates the rod-like end piece of the adjacent mast section B. The inside surfaces of the bifurcated end 10 serve at the same time here as a guide for preventing tilting in the swivel direction. The two mast sections A and B are connected by a joint bolt or joint pin 11 (see FIG. 3), which is arranged inside a joint bush or bore hole 15, of which only the joint eye 12 is visible in FIG. 2.

As further evident from FIG. 2, the two interconnected exemplary mast sections A and B can execute a swivel movement about a swivel joint axle 13. The swivel joint axle 13 is identical with the center line of joint pin 11 and with the center line of the joint bush 15 and runs perpendicular to the common center line 14. The instantaneous position of the two mast sections A and B relative to each other can be described by the swivel angle γ.

FIG. 3 shows the articulated mast joint of FIG. 2 in partial cross-section as viewed from a vertical direction (from above and against the z-axis of FIG. 1). The joint bolt 11 for both mast sections A and B is arranged inside a joint bush or bore hole 15 and secured in the known manner. As a result of the inside guide surfaces of the bifurcated end 10 of the mast section A, the end piece of the mounted mast section B is aligned transverse to the swivel direction and guided such that the two mast sections A and B, regardless of the instantaneous swivel angle, are always in alignment along a common axis 14. The swivel joint axle 13 and the common longitudinal axis 14 are always at right angles to each other.

FIG. 4 shows the swivel joint 8 of FIGS. 2 and 3 in a side view, i.e. as per FIG. 1 from a horizontal direction. The two swiveling interconnected mast sections A and B assume a swivel angle here γ of 180° to each other, as a result of which the mast sections concerned are spaced apart from each other at the maximum distance. In practice, the maximum swivel angle is often less or more than 180°. The maximum swivel angle can be set by means of structural measures, for example by means of end stops in the swivel joint or by the maximum stroke length of the actuating hydraulic cylinder.

The previously described prior art suffers from the problem that, as the articulated mast is being unfolded and, importantly, when it is in its working position, the offset generates large, weight-related transverse forces that are caused by the extent to which the mast sections are laterally staggered by the amount d (as per FIG. 1). The transverse forces generate high torsional moments in the mast sections, particularly in the region of the offset 9, but also lead to flexural moments and to a resulting tilting moment that acts on the entire articulated mast 1. For this reason, the mast sections concerned must be of a particularly rigid and thus heavy design. Similarly, the swivel joints 8 and the attachment of the articulated mast 1 to the mast pedestal 2 have to be designed for these high loads. This leads to high structural and material outlay, which also means that the overall weight of the articulated mast 1 and the mast pedestal 2 is large.

FIG. 5 shows the inventive embodiment with a swivel joint 81 having an inclined swivel joint axle 131. In the illustration shown here, the two exemplary mast sections A and B assume a position as per FIG. 4, that is, the swivel angle γ is almost 180°, with the two mast sections A and B aligning in this position along a common longitudinal axis 14, as per the illustration in FIG. 5. The joint bore hole 151 is designed such that its center line, which corresponds to the swivel joint axle 131, assumes a non-vertical angle to the common longitudinal axis 14. If the mast section B accommodated in the bifurcation 10 is swiveled about the skew swivel joint axle 131, it moves skew in space and thus outside a vertical reference plane which extends plumb with the common longitudinal axis 14. When the mast section B is swiveled out of its aligned position with the mast section A (as per FIG. 5), it moves accordingly into a position in which it is laterally staggered from mast section A. Applied to the articulated mast 1, this means that as a mast section which, in the working position, is initially in alignment with the preceding mast sections, is being folded into the resting or transport position, it assumes a position in which it is guided laterally past the preceding mast sections, and more precisely is deflected. The disadvantageous offset of this mast section can therefore be dispensed with. The overall complex mechanism will be discussed in detail below.

The complex sequence of movements associated with the folding and unfolding of the articulated mast 1 can be described in simple terms with the aid of FIGS. 6, 7*a* and 7*b*. FIG. 6 shows a schematic, perspective view of an unfolded articulated mast as per FIG. 1 and comprising a total of four mast sections 4 to 7. Viewed from a vertical direction (against the z-axis of the space coordinate system), all four mast sections 4 to 7 are arranged in alignment along a common axis 14, as shown in FIG. 7*a*. Plumb with this common axis 14, but at least plumb with the longitudinal axis of the first mast section 4, a vertical plane can be created, which may be designated vertical reference plane 16. In the example illustrated in FIG. 6, the vertical reference plane only runs along the y-axis of the space coordinate system by chance.

In the case of an articulated mast with swivel joints of conventional design as per the example of FIGS. 2 to 4, the mast sections 4 to 7 move exclusively within the vertical reference plane 16 during folding and unfolding. If the articulated mast has offset mast sections, the staggered mast sections move exclusively in planes parallel to the vertical reference plane 16 during folding and unfolding. As already described, transverse forces result from the staggered mast sections and lead to torsional moment, flexural moment and articulated moment loads.

In the case of an articulated mast 1 comprising a swivel joint 81 with inclined swivel joint axle 131 (as per the example in FIG. 5), the articulated mast section, which is swiveled about this inclined swivel joint axle 131 and which corresponds to the exemplary mast section B, moves skew relative to the vertical reference plane 16, with the skew position continuously changing during the swivel movement. Only in a predetermined position, which, for example, can be described by the swivel angle γ formed with the preceding mast section, are these two mast sections located within the vertical reference plane 16, that is, in an ideal aligned working position. When the articulated mast is folded from its working position into its resting or transport position, the articulated mast section, which swivels about the inclined swivel joint axle 131 and which corresponds to the exemplary mast section B, splays into a spread angle α, from the preceding mast section, that is, is laterally deflected from this. This means that the articulated mast section corresponding to mast section B essentially can be formed so as to have an extended configuration, i.e. without offset, as a result of which the disadvantages associated with the offset are eliminated. Since the transverse forces do not occur, the mast sections can be designed to be less rigid, as a result of which weight, manufacturing outlay and costs are reduced. The same is true for attachment of the articulated mast 1 to the mast pedestal 2, which can be made commensurately smaller due to a reduced lateral tilting moment of the articulated mast 1.

FIGS. 7*a* and 7*b* illustrate with the example of a four-member articulated mast 1, the position assumed by the third, and in this case not the offset mast section 6, in the working position (FIG. 7*a*) and in the resting or transport position (FIG. 7*b*). In the working position, as a result of the inclined swivel joint axle 131, the third mast section 6 is in alignment with the preceding mast sections 4 and 5 along a common axis 14, and thus also aligned within the vertical reference plane 16 (see FIG. 6). This eliminates transverse forces resulting from an offset of the mast section. In its resting or transport position, however, the same mast section 6 projects out from its preceding mast section 5 at a spread angle α because of the inclined swivel joint axle 131. As a result, it is guided past the preceding mast section, more precisely, deflected from it. The inclination of the swivel joint axle 131 thus avoids the disadvantages associated with the offset 9. As a result, savings are made on material and weight, and production outlay is reduced.

While, in the case of the offset, the transverse forces are always act in full, that is, during folding and unfolding of the articulated mast 1, in the case of the inventive solution with inclined swivel joint axle 131, the transverse forces arising from the splayed mast section decrease continuously during the unfolding process and are practically non-existent in the ideal working position. With the inventive articulated mast 1, therefore, relative to the prior art in terms of transverse forces and the resulting moments, a significant improvement also occurs when the articulated mast is operated in a mast section configuration that does not match the ideal working position.

Since the third mast section 6 in the example of the FIGS. 7, 7*a* and 7*b* is followed by a further, fourth mast section 7, it is expedient to also mount this by means of an inclined swivel joint axle. In the resting or transport position of the articulated mast 1, the fourth mast section 7 as per the illustration in FIG. 7*b* sets itself off from the already inclined third mast section 6 at an angle of spread α and thus once again is essentially parallel with the first or second mast section 4 or 5. In the event that the second mast section of a multi-member articulated mast is mounted to the preceding first mast section by means of an inclined swivel joint axle, similar considerations apply to the subsequent third mast section. An otherwise offset mast section therefore has in accordance with the invention a straight design, but inclined swivel joint axles 131 are incorporated into the articulated mast 1.

FIG. 7*a* also illustrates the definition of the planar angles of inclination β and β', which the inclined swivel joint axles 131 assume relative to the perpendicular of a common longitudinal axis 14, with the common longitudinal axis 14 at least corresponding to an extension of the first mast section (4). The angles of inclination β and β' are determined for simplicity in a horizontal plane, with this horizontal plane, by definition, extending perpendicularly to the vertical reference plane 16. The swivel joint axles 13 of a conventional swivel joint 8, as per the embodiment of FIGS. 2 to 4, also correspond to the perpendicular of the common longitudinal axis 14.

The angle of inclination β is typically half the angle of spread (see FIG. 7*b*), under the proviso that the traversed swivel angle γ of the mast sections connected by means of this swivel joint 81 is at least 180° during folding and unfolding. The same applies to the relationship of the angle β' to α.

Since as per the above considerations, it is expedient to mount a mast section following the splayed mast section also by means of an inclined swivel joint axle 131, in this case the two angles of inclination β and β' should ideally have the same angle value, as shown in FIG. 7*a*. In this case, the angles of spread α and α' are equal so that the following mast section concerned is arranged in its resting or transport position, such that it is essentially parallel with its preceding mast section, especially the first mast section 4. This, however, applies initially in a restricted manner only in the event that the traversed swivel angles γ are the same for folding and unfolding at the two swivel joints 81 concerned. If the swivel angles differ, the swivel joint axles 131 would have to be additionally tilted differently under the same angle of inclination α and α' to ensure the same angles of spread α and α'.

The orientation of the angles of inclination β and β' results from the folding and unfolding sequence of the mast sections concerned. Typically, the angles of inclination β and β' have the same orientation, but may also have a different orientation.

Finally, it should be stressed that the swivel joints 81 with inclined swivel joint axle 131 have to be designed overall for the modified swivel mechanism. The embodiment of FIG. 5 allows, for example, some play in the form of a gap between the end piece of the mast section B and the bifurcated end 10 of the mast section A. In order that tilting of the mast sections A and B swiveled about the inclined swivel joint axle 131 against the swivel direction may be prevented in this embodiment, a guide arrangement 17 is provided, which also provides the equally necessary lateral guide surfaces for this swivel joint. A first guide surface of such a guide arrangement may, for example, have a one-piece configuration with the bifurcation 10 of the mast section A, and the corresponding mating section may have the one-piece configuration with the rod-like formed end piece of mast section B. The guide arrangement 17 can also be built up from several spacers, which have appropriately designed inclined surfaces. Other embodiments are also possible.

For a practical embodiment of an articulated mast 1 with inclined swivel joint axle or inclined swivel joint axles 131, the angles of inclination β and β' should not exceed a maximum value of 10°, preferably not exceed 8°. This yields an angle of spread α or α' that is approximately twice as large as what is currently considered a practicable value.

The invention claimed is:

1. An articulated mast for a thick-matter delivery installation comprising at least a first mast section and a second mast section, said second mast section having first and second ends, said first and second mast sections both extending along a longitudinal axis and connected by means of a first swivel joint wherein the second mast section immediately preceding the first mast section, may be swiveled from a folded transport position of the articulated mast, into an unfolded working position, wherein, the second mast section is mounted by its first end to the immediately preceding first mast section via a longitudinal axis-centered male/female joint forming a first inclined swivel joint axle, such that the first and second mast sections when in the unfolded working position of the articulated mast are essentially aligned in a vertical reference plane that is plumb with the first mast section, and when in the folded transport position the second mast section is deflected from the first mast section under a defined angle of spread ($\alpha$); and wherein said articulated mask has a first working position and a second transport position, said first working position having a concrete delivery line associated with said mast.

2. The articulated mast of claim 1 wherein, the first inclined swivel joint axle forms an angle of inclination ($\beta$), said angle of inclination being a maximum of 10° determined in a horizontal plane.

3. The articulated mast in accordance with claim 1, wherein at the second end of the second mast section, a third mast section is mounted via a second inclined swivel joint axle, such that the second and the third mast section in the unfolded working position of the articulated mast are essentially aligned in a vertical reference plane, and in the folded transport position the third mast section is essentially arranged parallel to the first mast section, wherein the longitudinal axis of the second mast section describes a second angle of spread ($\alpha'$) with the longitudinal axis of the third mast section.

4. The articulated mast of claim 3, wherein the angle of spread ($\alpha$) is roughly twice as large as the angle of inclination ($\beta$) and the second angle of spread ($\alpha'$) is roughly twice as large as a corresponding second angle of inclination ($\beta'$).

5. The articulated mast of claim 3, wherein the angles of inclination ($\beta$, $\beta'$) for the first and second inclined swivel joint axles are equal.

6. The articulated mast in accordance with claim 1, wherein the articulated mast comprises at least three mast sections.

7. The articulated mast in accordance with claim 1, wherein when in the working position of the articulated mast the mast sections are essentially aligned in a vertical reference plane, wherein said thick matter comprises concrete in a liquid form.

8. A thick-matter delivery installation system comprising at least one pump for delivering thick matter and a thick-matter delivery line which is arranged at an articulated mast, wherein the articulated mast is constructed from mast sections connected by articulation, the articulated mast comprising at least a first mast section and a second mast section, said second mast section having first and second ends, said first and second mast sections extending along a longitudinal axis and connected by a swivel joint so that the second mast section may be swiveled from a folded transport position into an unfolded working position, wherein the second mast section is mounted by its first end to a first-mast section via a longitudinal axis-centered male/female joint forming a first inclined swivel joint axle, such that the first and second mast sections, when in the unfolded working position of the articulated mast, are essentially aligned in a vertical reference plane that is plumb with the first mast section, and in the folded transport position, the second mast section is deflected from the first mast section by a defined angle of spread ($\alpha$).

* * * * *